United States Patent [19]

Bennett

[11] 4,088,425

[45] May 9, 1978

[54] MANUALLY OPERATED PUMP FOR DISPOSABLE CONTAINER

[76] Inventor: Robert A. Bennett, 170 Sturbridge Rd., Easton, Conn. 06425

[21] Appl. No.: 758,034

[22] Filed: Jan. 10, 1977

[51] Int. Cl.[2] ..... B05B 1/00; B05B 11/00; F04B 21/04; F04B 7/02

[52] U.S. Cl. ..... 417/444; 417/550; 417/554; 222/321; 222/380; 222/385

[58] Field of Search ..... 417/328, 444, 550, 554; 222/321, 380, 383, 385, 496

[56] References Cited

U.S. PATENT DOCUMENTS

| | | | |
|---|---|---|---|
| 3,452,905 | 7/1969 | Micallef | 222/321 |
| 3,746,260 | 7/1973 | Boris | 222/385 |
| 3,908,870 | 9/1975 | Nozawa et al. | 222/321 |
| 3,923,250 | 12/1975 | Boris | 222/385 |
| 3,954,354 | 5/1976 | Boris | 417/550 |
| 4,025,046 | 5/1977 | Boris | 222/385 |
| 4,033,487 | 7/1977 | Micallef | 222/321 |
| 4,051,983 | 10/1977 | Anderson | 222/321 |

FOREIGN PATENT DOCUMENTS

| | | | |
|---|---|---|---|
| 1,339,657 | 9/1963 | France | 417/554 |

*Primary Examiner*—John J. Vrablik

[57] ABSTRACT

The vertical hollow sleeve of a pump has a bottom open end receiving the top open end of a container with fluid. A top section of the sleeve has a first vertical bore with a bottom surface communicating with the bottom thereof and contoured to receive a convex diaphram. A hollow vertical extension slidably disposed in the first bore has a second vertical bore with a top disposed first orifice. The tip of a vertical member slidably disposed in the first bore fits movably into the first orifice. A mechanism engaging the extension and bottom surface has a horizontal chamber which in vertical cross section has the shape of a horizontally elongated axis. The diaphram forms the top surface of the chamber. The bottom surface of the chamber is formed by the rigid top end of a vertical cylinder which has a third vertical bore receiving the member. The member has a fourth vertical bore which communicates with an enlarged hollow region in the chamber. Slits in the region interconnect the interiors of the region and chamber. A ball is disposed movably in the chamber. A spring loaded device is disposed in the cylinder and engages the member. The pump expels a metered amount of fluid at each stroke.

4 Claims, 3 Drawing Figures

MANUALLY OPERATED PUMP FOR DISPOSABLE CONTAINER

BACKGROUND OF THE INVENTION

This invention is directed toward a small inexpensive manually operated non pulsating pump which is installed in a disposable container having fluid therein such as a shaving lotion or the like to dispense fluid therefrom and which is disposable with the container.

Known pumps of this type produce a discharge of fluid which can vary in amount depending upon the manual pressure and speed of manual operation.

A pump in accordance with this invention employs a novel type of chamber into which fluid is first fed and then discharged from and a novel type of air venting means whereby a fixed quantity of fluid is discharged when the pump is operated regardless of a wide range of variations in manual pressure and speed of manual operation.

SUMMARY OF THE INVENTION

In accordance with the principles of the invention, there is provided a manually operated pump adapted to be secured detachably to the top open end of a vertical container with fluid therein to expel a metered amount of fluid at each stroke.

The pump employs a vertical hollow sleeve having a bottom open end for receiving the top open end of the container, said sleeve having a top section with a circular recess in its top surface, said section having a central vertical first bore and also having a bottom surface contoured to receive a convex diaphram and communicating with the bottom of the first bore. The sleeve has a horizontal circular shoulder projecting inwardly from the inner wall of thesleeve and disposed immediately below said bottom surface.

A unit is disposed in said sleeve and said first bore, said unit including a hollow vertical extension disposed slidably in the first bore and extending thereabove, said extension containing second and third vertically aligned vertical bores separated by a first horizontal orifice, the top end of thesecond bore and the bottom end of the third bore being open. Theunit further includes a central mechanism engaging said extension, said shoulder and said bottom surface of the top section, said mechanism including a horizontal chamber which is vertical cross section has the shape of an ellipse with an elongated horizontal axis. The mechanism includes a flexible normally convex diaphram forming the upper surface of the chamber, the diaphram having a central opening peripherally engaging the bottom end of the extension and communicating with said third bore. The mechanism further includes a vertical cylinder having a concave rigid enlarged top end forming the lower surface of said chamber and a bottom end with a vertical recess therein, said recess having a top end with a second horizontal orifice. The cylinder has a fourth vertical bore having a top opening in said enlarged top end of the cylinder vertically aligned with said third bore and terminating at the bottom end of the cylinder.

A vertical member is slidably disposed in third bore and extends slidably downwardly through said diphram and the top end of the cylinder part way into said fourth bore. The member has a top disposed tip, and also has a fifth vertical bore extending upwardly from an opening in the bottom end of the member to an enlarged hollow region. The fifth bore communicates with said region. The region is disposed within said chamber and has a top portion with slits communicating both with the interior of the region and the interior of the chamber.

A ball is movable up and down in the region between a normal bottom position at which it seals the fifth bore and a raised position at which fluid can flow through the second orifice, said fifth bore, said region and said slits into said chamber.

Spring loading means in the cylinder engages said member, said means in the absence of downward pressure on said member pressing upwardly upon said member to move said tip into sealing engagement with said first orifice, said member when momentarily manually depressed against the pressure of the spring being momentarily moved downward to provide clearance between said tip and said first orifice.

An air vent path extends through a vent passage in the top section, then through a channel between the contoured bottom surface of thesection and the outer surface of the diaphram, then through a channel between the shoulder and the central mechanism and finally into the interior of the sleeve.

A hollow dip tube has a top open end disposed in the bottom recess of the cylinder and communicating with the second orifice. The bottom open end of the tube extends below the fluid level of the container. A top disposed hollow overcap engages the circular recess in the top end of the sleeve, said cap having a side opening communicating with the open top end of the second bore, said cap when despressed bearing against the top end of the member to push same downward and flex said diaphram, the spring means when downward pressure is not exerted on said cap restoring the cap to original position whereby the diaphram is unflexed.

After the pump is primed by the first cycle of downward pressure and release, the chamber is filled with fluid. On the next down stroke, the pressure produced by the flexed diaphram forces all of the fluid in the chamber to be expelled through the side opening in the cap. The ball seals the fifth bore and prevents fluid leakage through the bore. On the following up stroke, the diaphram becomes unflexed, creating a suction force which momentarily lifts the ball and pulls fluis upward from the container into the chamber to fill it.

The chamber is completely filled and completely emptied during the appropriate up and down strokes whereby the same amount of fluid is always discharged for each pump cycle.

DETAILED DESCRIPTION OF PREFERRED EMBODIMENT

Figure 1:
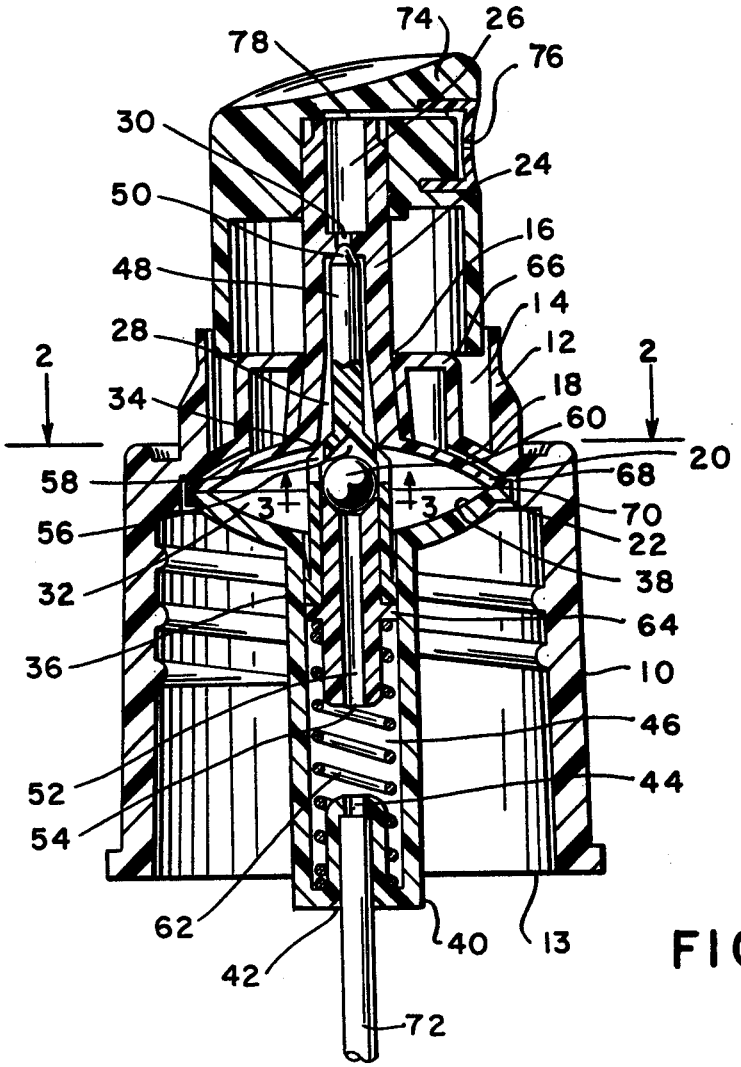
FIG. 1 is a vertical cross sectional view of the invention.
Figure 2:
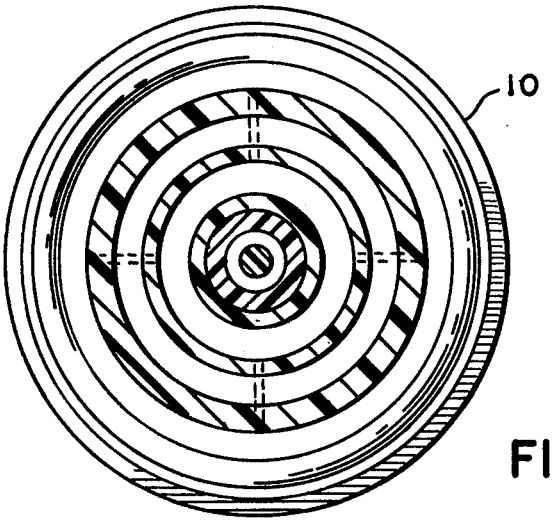
FIG. 2 is a view taken along line 2—2 of FIG. 1.
Figure 3:
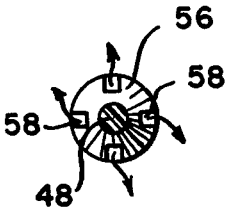
FIG. 3 is a view taken along line 3—3 of FIG. 1

As shown in the Figures, a vertical hollow sleeve 10 has a bottom open end 12 which can be screwed upon a suitably threaded neck of a container having fluid therein. Sleeve 10 has a top section 12 with a circular recess 14 in the top surface. Section 12 has a central vertical first bore 16 therein and also has a bottom surface 18 contoured to receive a convex diaphram 20, this surface communicating with the bottom of bore 16. Sleeve 10 has a horizontal circular shoulder 22 projecting inwardly from the inner wall of the sleeve and disposed immediately below the bottom surface.

A unit is disposed in the sleeve and bore 16. This unit includes a hollow vertical extension 24 disposed slidably in the first bore and extending thereabove. Extension 24 contains second and third vertically aligned vertical bores 26 and 28 separated by a horizontal first orifice 30. The top end of bore 26 and the bottom end of bore 28 are both open.

The unit also includes a central mechanism engaging extension 24, shoulder 22 and bottom surface 18. The mechanism includes a horizontal chamber 32 which in vertical cross section has the shape of an ellipse with an elongated horizontal axis. The mechanism enmploys flexible convex diaphram 20 as forming the upper surface of chamber 32. The diaphram has a central opening 34 and communicating with bore 28. The mechanism further includes a vertical cylinder 36 having a rigid concave enlarged top and end 38 which forms the lower surface of chamber 32 and also has a bottom end 40 with a vertical recess 42 therein. The recess has a top end with a horizontal second orifice 44 therein. The cylinder has a fourth vertical bore 46 with a top opening in end 38 and terminating at end 40. Bore 46 is vertically aligned with bore 28.

A vertical member 48 is disposed slidably in the bore 28 and extends slidably downward through opening 34 in the diaphram end 38 of the cylinder, part way into bore 46. Member 48 has a top disposed tip 50.

Member 48 has a fifth vertical bore 52 extending upwardly from an opening 54 in the bottom end to an enlarged hollow region 56. The bore 52 communicates with region 56 which is disposed within chamber 32. Region 56 has a top portion with slits 58 therein. These slits communicate both with the interior of the chamber 32 and with the region 56.

A ball 60 is disposed in the region and is movable up and down therein between a normal bottom position at which it seals the fifth bore and a raised position at which fluid can flow through orifice 44, bore 52, region 56 and slits 58 into chamber 32.

A return spring 62 in the cylinder bears against an enlarged horizontal circular stop 64 on the outer surface of member 48. This spring, in the absence of downward pressure on member 48, presses upwardly upon the member to move the tip 50 into sealing engagement with orifice 30. The member 48, when momentarily manually depressed against the pressure of spring 62 is momentarily moved downward to provide clearance between the tip 50 and orifice 30.

An air vent path extends through a vent passage 66 in section 12, then through a channel 68 between surface 18 and the outer surface of the diaphram, then through a channel 70 between the shoulder 22 and the juncture of diaphram 20 and end 38 and finally into the main interior of the sleeve.

A hollow dip tube 72 open at top and bottom ends has its open top end disposed in recess 42 and communicating with orifice 44. The bottom end is adapted to extend into the fluid when the pump is secured to a container.

A top disposed overcap 74 engaged recess 14 in section 12. Cap 74 has a side opening or orifice 76 communicating via channel 78 to the open top end of bore 26. When the cap is pressed downward with sufficient pressure a pressure buildup occurs in bore 28 causing the member 48 to press downward on spring 62, releasing liquid through orifice 30, bore 26, channel 78 and outward through orifice 76. When the cap is released, the pressure of the spring moves the vertical member 48 and cap upward, the orifice 30 is closed, the ball moves upward because of the suction produced by the return to unflexed position of the diaphram and fluid is drawn upward to fill the chamber 32. At this point, the pressure is equalized, the ball returns to normal position and the pump can be operated again as desired.

I claim:

1. A manually operated pump adapted to be secured detachably to the top open end of a vertical container with fluid therein to expel a metered amount of fluid at each stroke, said pump comprising:

a vertical hollow sleeve having a bottom open end for receiving the top open end of the container, said sleeve having a top section with a circular recess in its surface, said section having a central vertical first bore and also having a bottom surface contoured to receive a convex diaphram and communicating with the bottom of the first bore, said sleeve having a horizontal circular shoulder projecting inwardly from the inner wall of the sleeve and disposed immediately below said bottom surface;

a unit disposed in said sleeve and said first bore, said unit including a hollow vertical extension disposed slidably in the first bore and extending thereabove, said extension containing second and third vertically aligned vertical bores separated by a first horizontal orifice, the top end of the second bore and the bottom end of the third bore being open, said unit further including a central mechanism engaging said extension, said shoulder and said bottom surface of the top section, said mechanism including a horizontal chamber which in vertical cross section has the shape of an ellipse with an elongated horizontal axis, said mechanism having a flexible normally convex diaphram forming the upper surface of the chamber, the diaphram having a central opening peripherally engaging the bottom end of the extension and communicating with said third bore, said mechanism further including a vertical cylinder having a concave rigid enlarged top end forming the lower surface of said chamber and a bottom end with a vertical recess therein, said recess having a top end with a second horizontal orifice, the cylinder having a fourth vertical bore having a top opening in said enlarged top end of the cylinder vertically aligned with said third bore and terminating at the bottom end of the cylinder;

a vertical member slidably disposed in third bore and extending slidably downwardly through said diaphram and the top end of the cylinder part way into said fourth bore, said member having a top disposed tip, said member having a fifth vertical bore extending upwardly from an opening in the bottom end of the member to an enlarged hollow region, said fifth bore communicating with said region, said region being disposed within said chamber and having a top portion with slits communicating both with the interior of the region and the interior of the chamber;

a ball movable up and down in the region between a normal bottom position at which it seals the fifth bore and a raised position at which fluid can flow through the second orifice, said fifth bore, said region and said slits into said chamber; and spring loading means in the cylinder and engaging said member, said means in the absence of downward pressure on said member pressing upwardly upon said member to move said tip into sealing engagement with said first orifice, said member when momentarily manually depressed against the pressure of the spring being momentarily moved downward to provide clearance between said tip and said first orifice.

2. The pump of claim 1 wherein an air vent path extends through a vent passage in the top section, then through a channel between the contoured bottom surface of the section and the outer surface of the diaphram, then through a channel between the shoulder and the central mechanism and finally into the interior of the sleeve.

3. The pump of claim 2 further including a hollow dip tube having a top open end disposed in the bottom recess of the cylinder and communicating with the second orifice.

4. The pump claim 3 further including a top disposed hollow overcap engaging the circular recess in the top end of the sleeve, said cap having a side opening communicating with the open top end of the second bore, said cap when depressed bearing against the top end of the member to push same downward and flex said diaphram, the spring means when downward pressure is not exerted on said cap restoring the cap to original position whereby the diaphram is unflexed.

* * * * *